US009751061B2

(12) United States Patent
Bergamini

(10) Patent No.: US 9,751,061 B2
(45) Date of Patent: Sep. 5, 2017

(54) POSITIONING AND SUPPORT DEVICE FOR TANKS FOR FLUID COLORING PRODUCTS

(71) Applicant: COROB S.P.A. CON SOCIO UNICO, San Felice Sul Panaro (IT)

(72) Inventor: Andrea Bergamini, Nonantola (IT)

(73) Assignee: Corob S.p.a. Con Socio Unico, San Felice sul Panaro (IT)

( * ) Notice: Subject to any disclaimer, the term of this patent is extended or adjusted under 35 U.S.C. 154(b) by 306 days.

(21) Appl. No.: 14/414,158

(22) PCT Filed: Jul. 11, 2013

(86) PCT No.: PCT/IB2013/001504
§ 371 (c)(1),
(2) Date: Jan. 12, 2015

(87) PCT Pub. No.: WO2014/009795
PCT Pub. Date: Jan. 16, 2014

(65) Prior Publication Data

US 2015/0196882 A1 Jul. 16, 2015

(30) Foreign Application Priority Data

Jul. 20, 2012 (IT) ..... UD2012A0127

(51) Int. Cl.
*B01F 15/00* (2006.01)
*B01F 13/10* (2006.01)
*B44D 3/14* (2006.01)

(52) U.S. Cl.
CPC .... *B01F 15/00772* (2013.01); *B01F 13/1055* (2013.01); *B44D 3/14* (2013.01)

(58) Field of Classification Search
CPC ..... B65D 81/32; B65D 1/04; B65D 81/3283; A61K 8/02; A61Q 11/00; B01F 15/04; B01F 13/00; B01F 13/10; B01F 13/1055; B01F 15/00292; B01F 15/0437;
(Continued)

(56) References Cited

U.S. PATENT DOCUMENTS 3,178,058 A 4/1965 Ogren
4,705,083 A * 11/1987 Rossetti ..... B01F 13/1055 141/1
(Continued)

FOREIGN PATENT DOCUMENTS

CA 2492967 A1 1/2006
DE 20 2005 007586 U1 8/2005
(Continued)

OTHER PUBLICATIONS

PCT Search Report and Written Opinion for PCT/IB2013/001504 issued Nov. 7, 2013.

*Primary Examiner* — Cassandra Davis
(74) *Attorney, Agent, or Firm* — Flaster/Greenberg P.C.

(57) ABSTRACT

A positioning and support device for tanks of fluid coloring products, comprising a plate having a plurality of through apertures into which the tanks are suitable to be inserted from above. Snap-in attachment elements are provided in correspondence with each of the through apertures to cooperate with one of the tanks and keep it positioned, at least temporarily, inside the corresponding through aperture.

6 Claims, 3 Drawing Sheets

(58) Field of Classification Search
CPC .... B01F 15/0462; B01F 15/0445; B44D 3/00; B44D 3/003
See application file for complete search history.

(56) References Cited

U.S. PATENT DOCUMENTS

| | | | | | |
|---|---|---|---|---|---|
| 5,223,245 | A * | 6/1993 | Ibrahim | A61K 8/02 | 206/568 |
| 5,398,827 | A * | 3/1995 | Armstrong | B65D 1/30 | 215/6 |
| 8,360,238 | B2 * | 1/2013 | Nicoletti | B65D 5/503 | 206/443 |
| 2008/0264822 | A1 | 10/2008 | Faiola | | |
| 2015/0108034 | A1 * | 4/2015 | Deutschle | A61J 1/16 | 206/562 |

FOREIGN PATENT DOCUMENTS

| | | | |
|---|---|---|---|
| EP | 1744826 | B1 | 10/2007 |
| WO | WO 86/02320 | A1 | 4/1986 |
| WO | WO 99/48802 | A1 | 9/1999 |
| WO | WO 02/083516 | A1 | 10/2002 |
| WO | WO 2007/045512 | A2 | 4/2007 |

* cited by examiner

POSITIONING AND SUPPORT DEVICE FOR TANKS FOR FLUID COLORING PRODUCTS

BACKGROUND OF THE INVENTION

Field of the Invention

The present invention concerns a positioning and support device to position and support, removably, one or more tanks of fluid coloring products, such as coloring agents or pigments, for example liquids. The positioning and support device according to the invention is applied particularly in machines for dispensing fluid coloring products.

Description of Related Art

In dispensing machines of fluid coloring products, also called dispensers, it is known to have an upper support plate, provided with a plurality of vertical through apertures or holes, into which to insert a corresponding tank containing a fluid coloring product.

Normally each tank is attached to the support plate by means of clamping screws disposed at the sides of each through aperture.

This renders the operations to assemble the tanks, of which there could be more than thirty in a dispenser, on the support plate, and also to remove and possibly replace them, both in the production stage and in the field, laborious and slow.

U.S. Pat. No. 3,178,058 describes a dispensing machine for colorants comprising a plate on which fork elements are made, to which corresponding tanks are hung by means of mating grooves.

The use of fork elements does not guarantee a stable and secure positioning in the case of possible sliding and accidental detachment, in particular after repeated operations of insertion and removal which cause a slackening of the grip of the fork elements.

BRIEF SUMMARY OF THE INVENTION

Purpose of the present invention is to produce a positioning and support device for tanks of fluid coloring products which allows to assemble and dismantle each tank quickly and simply, without the aid of clamping means which require the use of an auxiliary tool.

The Applicant has devised, tested and embodied the present invention to overcome the shortcomings of the state of the art and to obtain these and other purposes and advantages.

The present invention is set forth and characterized in the independent claim, while the dependent claims describe other characteristics of the invention or variants to the main inventive idea.

This new and original technical solution, which obtains all the above purposes and offers surprising and unforeseeable advantages, both in technical terms and economic terms with regard to lower costs, provides to obtain a positioning and support device for tanks of fluid coloring products which comprises a plate having a plurality of through apertures into which the tanks are able to be inserted from above.

In accordance with a main characteristic feature of the present invention, tooth-type snap-in attachment means are provided in correspondence to each of the through apertures to cooperate with one of the tanks and keep it positioned, at least temporarily, in a stable and secure way, inside the corresponding through aperture.

In this way each individual tank can be advantageously assembled and dismantled with a simple manual operation of insertion and extraction which requires very little time, also without using a tool, in any case guaranteeing a secure and stable positioning, even over time, in the desired position determined by the position of the tooth-type snap-in attachment means.

The presence of the tooth-type snap-in attachment means allows to achieve considerable and real advantages in terms of time and simplicity in the assembly and dismantling operations of each tank.

Moreover, in accordance with a secondary characteristic of the present invention, each of the tooth-type snap-in attachment means comprises a tongue protruding upward with respect to the through aperture for the insertion of the respective tank, and therefore to the plane of the plate, and having a tooth facing toward the inside of the corresponding through aperture.

Moreover, in accordance with a secondary characteristic of the present invention, the plate is shaped so as to define a plurality of horizontal planes offset with respect to each other to define an amphitheater shape, declining from the median and rear part, which is higher, toward the lateral and front parts, which are lower, so as thus to facilitate the operations to fill the tanks.

BRIEF DESCRIPTION OF THE SEVERAL VIEWS OF THE DRAWINGS

These and other characteristics of the present invention will become apparent from the following description of a preferential form of embodiment, given as a non-restrictive example with reference to the attached drawings wherein.

DETAILED DESCRIPTION OF THE INVENTION

Figure 1:
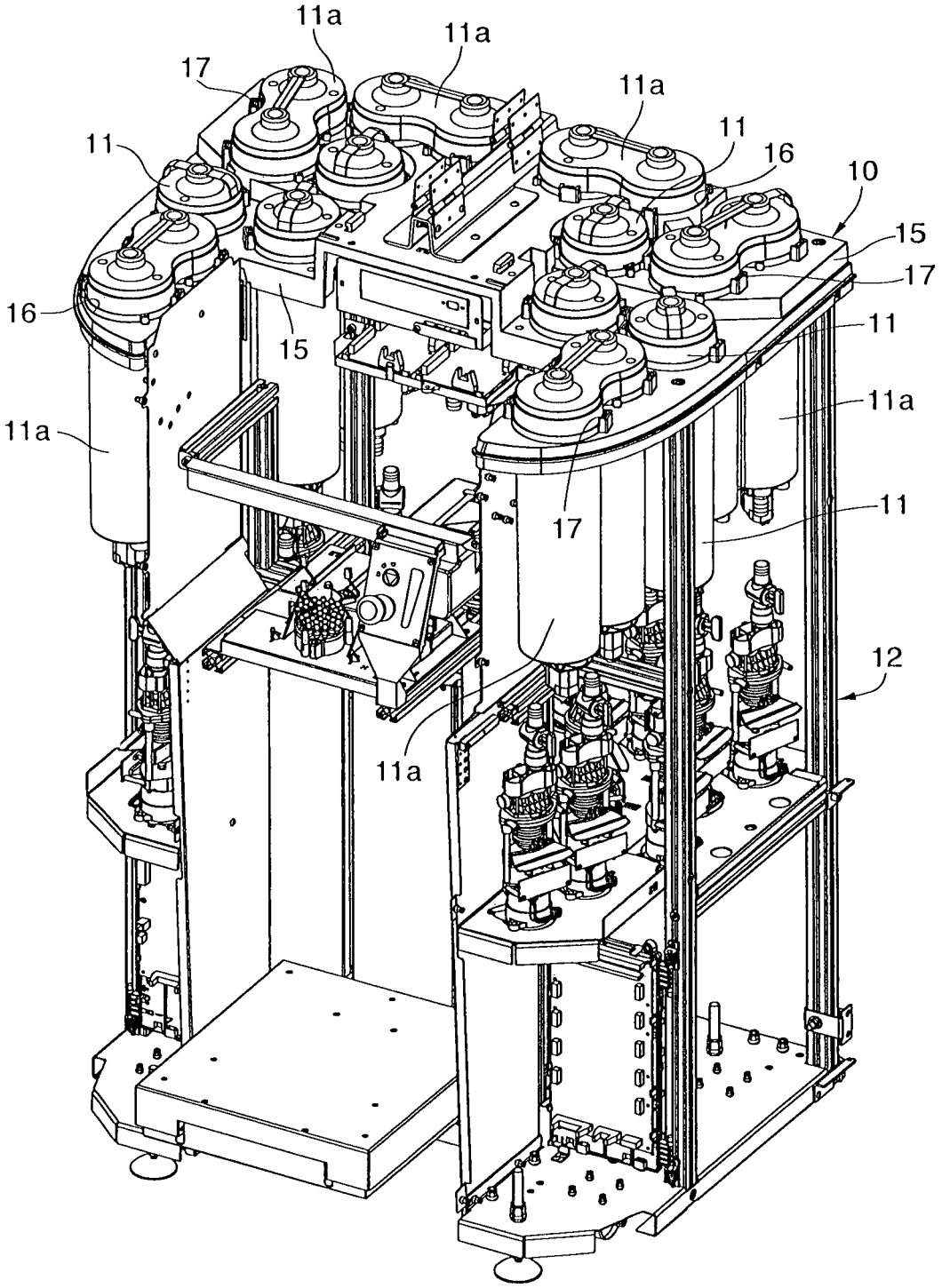
FIG. 1 is a perspective and schematic view of the positioning and support device for tanks of fluid coloring products according to the present invention, installed in a machine for dispensing said products.
Figure 2:
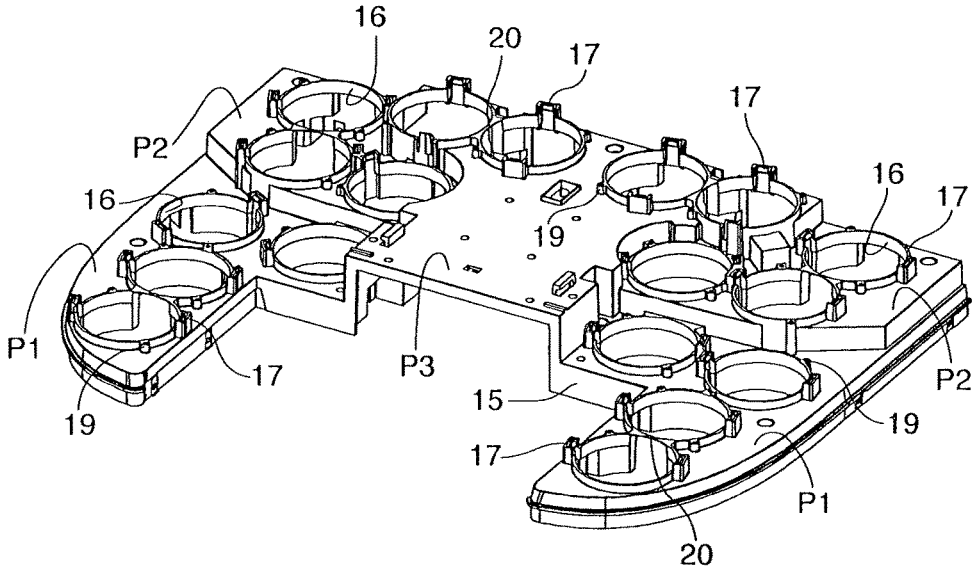
FIG. 2 is a perspective view of the positioning and support device in FIG. 1.
Figure 3:
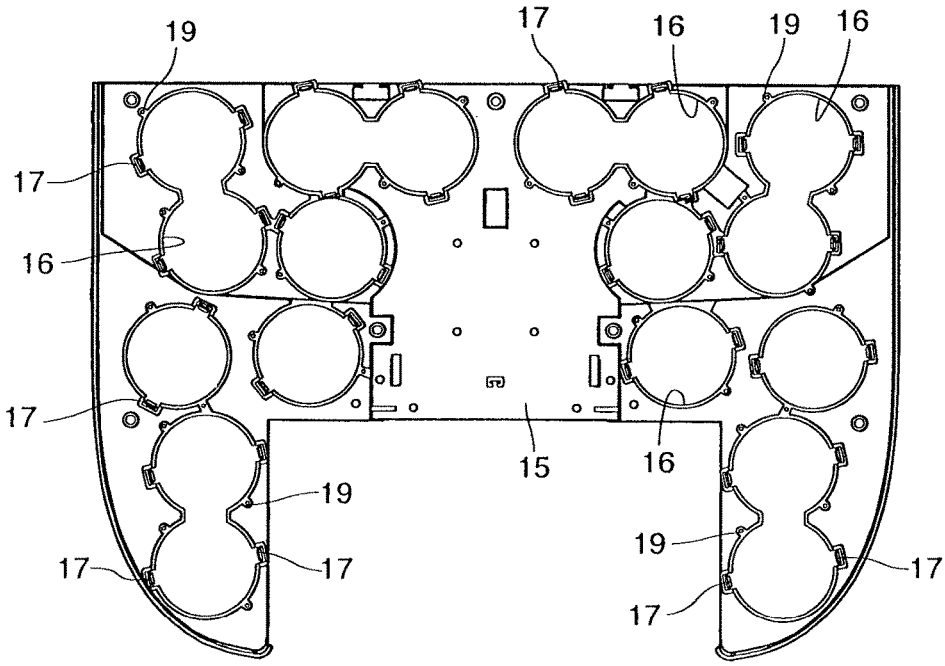
FIG. 3 is a plan view of the positioning and support device in FIG. 1 already predisposed to receive bigger tanks.

With reference to FIG. 1, a positioning and support device 10 according to the present invention, to support a plurality of tanks 11 of fluid coloring products, such as for example liquid colored pigments, is shown installed in a dispensing machine 12 of fluid coloring products. The machine 12 can be of any known type, or, for example, like the one described in the patent application for industrial invention which the Applicant has filed at the same time as the present patent application.

Figure 5:
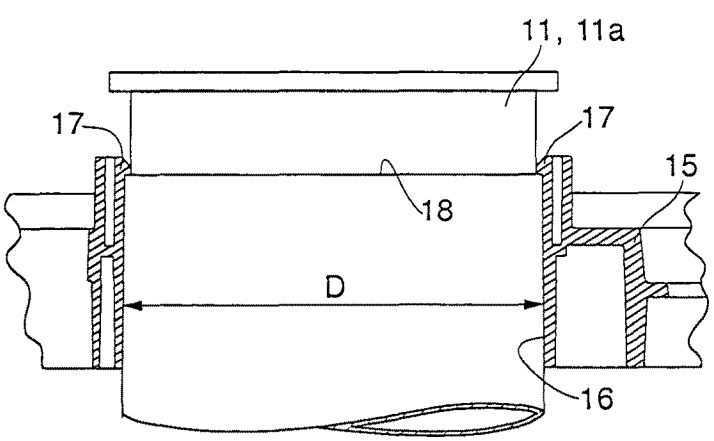
FIG. 5 is a section from V to V of FIG. 4.
Figure 4:
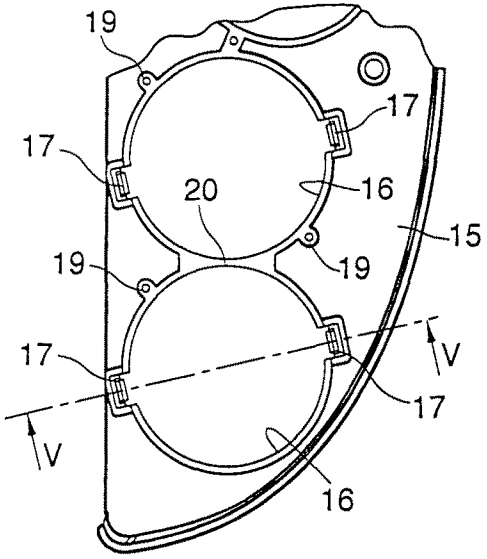
FIG. 4 is a view from above of an enlarged detail of the positioning and support device in FIG. 2.

The tanks 11 have a substantially cylindrical shape and a determinate diameter D (FIG. 5), of about 110 mm for example; on the other hand they are of different heights, which thus define different containing capacities, for example from 1 to 5 liters. Alternatively, the tanks, indicated by the reference number 11*a* (FIG. 1), rather than being cylindrical, can have a cross section substantially shaped like the figure eight, like the one described in the European patent EP-B-1.744.826, granted to Applicant 17 Oct. 2007. Each tank 11*a*, which thus becomes a bigger tank, is obtained by putting two cylindrical elements with the same diameter D adjacent to each other and joining them, thus defining a single containing compartment.

The positioning and support device 10 comprises a plate 15, made of plastic material for example, and obtained by injection molding, in which there is a plurality of through apertures 16 (FIGS. 2-5), which in this case are holes with a circular cross section and with diameter D, into which both the cylindrical tanks 11 and the bigger tanks 11*a* are suitable to be inserted from above, as will be explained in more detail hereafter.

Figure 6:
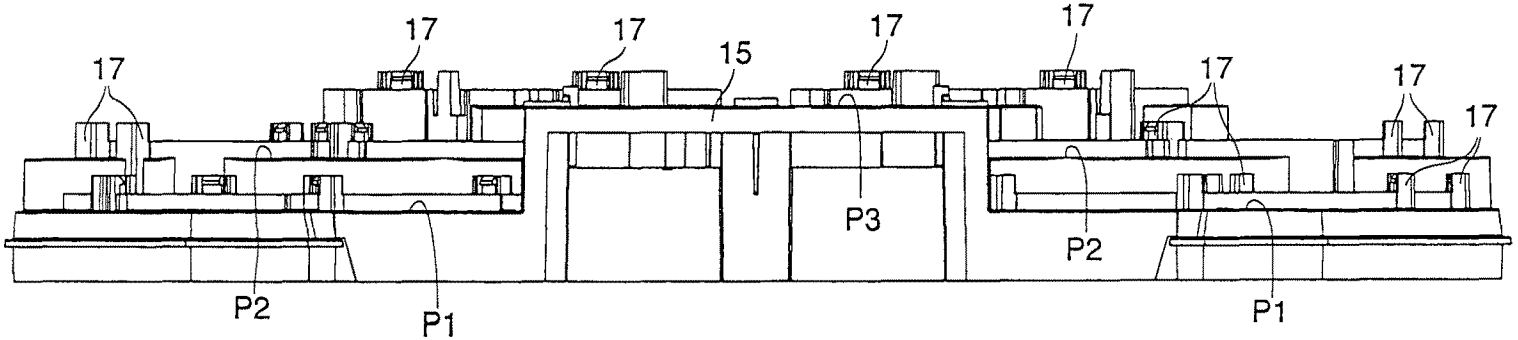
FIG. 6 is a front view of the positioning and support device in FIG. 1.

The plate 15 is suitable to be assembled on the upper part of the machine 12 (FIG. 1) and is shaped so as to define three horizontal planes P1, P2 and P3 (FIGS. 2 and 6), offset with respect to each other to define an amphitheater shape, declining from the median and rear part, which is higher, toward the lateral and front parts, which are lower, so as thus to facilitate the operations to fill the tanks 11 and 11*a*. The disposition on several levels in a decreasing direction from the outside toward the inside facilitates the operation of bringing the top-up receptacle containing the colorant in proximity to the edge of each tank 11, and renders the inside of the tank 11, 11*a* more visible, reducing the risk of leakages of colorants when the top-up is carried out.

The plate 15 also comprises tooth-type snap-in attachment members 17, with a tongue shape facing upward and provided with an attachment tooth facing toward the inside of the through aperture 16 (FIG. 5), of the snap-in type. The tooth-type snap-in attachment members 17 are disposed in pairs in diametrically opposite positions in correspondence to each through aperture 16 and are suitable to cooperate with an annular shoulder 18 of each tank 11, 11*a*. For example, the tooth-type snap-in attachment members 17 are made in a single piece with the remaining part of the plate 15 during the molding of the latter.

According to a variant, not shown in the drawings, but easily understandable for a person of skill in the art, the tooth-type snap-in attachment members 17 can be assembled individually on the plate 15, using screws for example, or in their turn snapped into suitable holes made in the plate 15 adjacent to the through apertures 16.

According to another variant, not shown in the drawings, but easily understandable for a person of skill in the art, the plate 15 can be divided into several parts, that is, a main part and one or more additional parts, on each of which there are both the through apertures 16 to accommodate the tanks 11, 11*a*, and also corresponding tooth-type snap-in attachment members 17.

Small holes 19 into which attachment screws can possibly be attached are provided in correspondence to each through aperture 16, in the plate 15. The attachment screws are not shown in the drawings but guarantee the attachment of the tanks 11, 11*a* if, during maintenance or the replacement of the tanks, one or more tooth-type snap-in attachment members 17 were to break.

Moreover, to allow the assembly and attachment of bigger tanks 11*a*, instead of two standard cylindrical tanks 11, on the plate 15, in determinate positions, there are separation elements 20, with a reduced thickness, which can easily be removed, even manually, in order to put two adjacent through apertures 16 in communication with each other and thus create a single suitable space to be able to insert a bigger tank 11*a* therein.

It is clear that modifications and/or additions of parts may be made to the positioning and support device 10 as described heretofore, without departing from the field and scope of the present invention.

It is also clear that, although the present invention has been described with reference to some specific examples, a person of skill in the art shall certainly be able to achieve many other equivalent forms of positioning and support device for tanks of fluid coloring products, having the characteristics as set forth in the claims and hence all coming within the field of protection defined thereby.

I claim:

1. A positioning and support device for tanks of fluid coloring products, comprising a plate having a plurality of through apertures into which tanks are suitable to be inserted from above, wherein tooth-type snap-in attachment means are provided in correspondence with each of said through apertures to cooperate with at least one tank and keep at least one tank positioned, at least temporarily, inside the corresponding through aperture and wherein each of said tooth-type snap-in attachment means comprises a tongue protruding upward with respect to the corresponding through aperture, and therefore to a plane of the plate, and having a tooth facing toward the inside of said through aperture;

wherein said plate is shaped so as to define a plurality of horizontal planes, offset with respect to each other to define an amphitheater shape, such that the plate declines from a median and rear part thereof, which is higher, toward a lateral part and to a front part thereof, which are lower, so as to facilitate operations to fill at least one tank.

2. The positioning and support device as in claim 1, wherein said tooth-type snap-in attachment means are made in a single piece with said plate.

3. The positioning and support device as in claim 1, wherein, in correspondence with each of said through apertures, said plate is also provided with little holes into which attachment screws are suitable to possibly be screwed, so as to attach a tank to said plate.

4. The positioning and support device as in claim 1, wherein each of said through apertures comprises a circular hole having a diameter equal to that of a tank, and wherein said snap-in attachment means are disposed on diametrically opposite sides of said circular hole.

5. The positioning and support device as in claim 4, wherein said plate is provided in determinate positions with separation elements configured to separate adjacent through apertures.

6. The positioning and support device as in claim 5, wherein the separation elements are removable so as to put adjacent through apertures in communication with each other.

* * * * *